US005653401A

United States Patent [19]

Biagiotti

[11] Patent Number: 5,653,401

[45] Date of Patent: Aug. 5, 1997

[54] APPARATUS AND METHOD FOR APPLYING A GLUE ON A CORE FOR THE WINDING OF WEB MATERIAL

[75] Inventor: Guglielmo Biagiotti, Capannori, Italy

[73] Assignee: Fabio Perini S.p.A., Italy

[21] Appl. No.: 537,721

[22] PCT Filed: May 6, 1994

[86] PCT No.: PCT/IT94/00055

§ 371 Date: Oct. 11, 1995

§ 102(e) Date: Oct. 11, 1995

[87] PCT Pub. No.: WO94/26642

PCT Pub. Date: Nov. 24, 1994

[30] Foreign Application Priority Data

May 14, 1993 [IT] Italy ..... FI93A9096

[51] Int. Cl.[6] ..... B65H 19/28

[52] U.S. Cl. ..... 242/532.3; 156/578

[58] Field of Search ..... 242/532.3; 118/410, 118/602; 156/578

[56] References Cited

U.S. PATENT DOCUMENTS

| | | | |
|---|---|---|---|
| 4,487,377 | 12/1984 | Perini . | |
| 4,931,130 | 6/1990 | Biagiotti | 156/446 |
| 5,040,738 | 8/1991 | Biagiotti . | |
| 5,199,991 | 4/1993 | Chance | 118/410 |
| 5,259,910 | 11/1993 | Biagiotti | 156/456 |

FOREIGN PATENT DOCUMENTS

| | | | |
|---|---|---|---|
| 0402325A2 | 12/1990 | European Pat. Off. . | |
| 2158371 | 11/1985 | United Kingdom | 118/410 |
| WO87/00091 | 1/1987 | WIPO | 118/410 |

*Primary Examiner*—John P. Darling

*Attorney, Agent, or Firm*—Francis J. Bouda; Breiner & Breiner

[57] ABSTRACT

The apparatus applies glue on tubular cores (A) to be inserted into a rewinder for the winding of logs (L) of web material (N). It includes a conveyor (33) to feed the cores in succession and means (37) for distributing the glue on the cores. The distributing means are provided with a dispenser (41–47) having at least one opening (43) through which the glue is delivered substantially continuously. The conveyor (33) moves each core (A) over the opening (43) to bring the core in contact with the dispensed glue to cause the application of the glue to the core during its movement over the opening. A flexible plate (81) acting onto the core on its side opposite to the glue dispenser (41–47) prevents the core from rotating during glue application.

17 Claims, 5 Drawing Sheets

APPARATUS AND METHOD FOR APPLYING A GLUE ON A CORE FOR THE WINDING OF WEB MATERIAL

DESCRIPTION

1. Technical Field

The invention refers to an apparatus for applying a glue on tubular cores to be inserted into a rewinder for the winding of logs of web material, including a conveyor for feeding the cores in succession as well as means for distributing the glue over said cores.

2. Background of the Invention

Rewinding machines are well-known in the paper converting industry which, starting from large diameter rolls, produce small diameter rolls or logs of web material (mostly paper) wound on tubular cores. These logs are then cut along planes perpendicular to their axes to produce small rolls of toilet paper, all-purpose wipers or similar products. In many such rewinders, an apparatus is provided to apply glue on the tubular core prior to the insertion of the latter into the rewinder where the glue anchors the free edge of the web material to begin the log winding operation. Rewinders of this type are described in U.S. Pat. Nos. 4,487,377 and 4,931,130.

In rewinders of the prior art, the apparatus for applying the glue on the tubular cores is provided, in the majority of cases, by a rotating cylinder having annular projections which dip into a tank of glue, and which distribute the drawn glue on the core along annular rings or strips spaced apart over the tubular core. The core is brought into contact with the rotating cylinder and kept in rotation for the time necessary for a uniform application to the core of said annular strips of glue. In other solutions (such as in U.S. Pat. No. 4,931,130) a longitudinal strip of glue is applied on the core during the motion for the insertion thereof into the rewinder, this movement taking place with a trajectory parallel to the axis of the core and perpendicular to the direction of advancement of the web material towards the winding region.

In EP-A-0 395 593 a glue applicator is disclosed, wherein a linear strip of glue is applied by a rotating roller, means being provided for preventing the rotation of the core during glue application thereon.

DISCLOSURE OF THE INVENTION

A first object of the present invention is to provide an apparatus for applying glue on tubular cores, which is of simple construction and easy to maintain.

A further object is to provide an apparatus making it possible to reduce the times necessary for the distribution of glue and, accordingly, to increase the overall productivity of the rewinding machine.

A further object of the invention is to provide a simple apparatus for the distribution of glue allowing a more accurate and reliable anchorage of the free or leading edge of web material at the beginning of each winding operation.

Still a further object of the present invention is to provide an apparatus which, by optimizing the procedure for the application of glue onto the core, is able to reduce the problems arising from the spreading of glue over the web-winding rollers by the cores on which glue has been applied.

These and further objects and advantages, which will become apparent to those skilled in the art from the following description, are achieved with an apparatus wherein said glue-distributing means are provided with a dispenser having at least an opening through which the glue is delivered substantially continuously and in overflow fashion; and the core conveyor moves each core over said opening to cause, during the movement, the application of the glue to the core surface.

To obtain a proper application of the glue, means are advantageously provided which prevent the core from rotating as it moves over said opening, so as to have the glue distributed along an area having a substantially longitudinal development, that is, parallel to the core axis.

U.S. Pat. No. 5,259,910 (EP-A-O 481-929) shows an overflow gluer for gluing the tail of the log of web material coming from the rewinder. In this gluing apparatus, provision is made for a glue distributor having an opening from which the glue overflows in a substantially continuous way. The free tail of the log is partially unwound from said log and the latter is made to roll over the glue-distributing aperture from which said glue is fed by overflow. In this known apparatus, it is suggested to glue the tail of a log of web material by causing said log to roll on a glue distributor.

In the present invention, where the glue is applied to the core before the winding of the log, the principle of distributing glue by causing it to overflow, is applied in a substantially different way to a different type of product, which exhibits problems other than those of the finished log. In particular, the core must be controlled during the passage thereof through the distributor so that the core arrives close to the winding rollers in the proper angular position and comes into contact with the web material in the region where the glue is applied, while avoiding depositing glue on the winding rollers. Moreover, it is important to avoid the rolling of the core during the transit thereof through the glue dispenser, as the glue (owing to its high viscosity) tends to form filaments that may stain the core.

To achieve an optimal glue distribution on the core and particularly to avoid smearing glue onto the winding rollers, the invention provides means for removing a portion of the applied glue during the movement of the core over the dispensing opening. To this end, in a particularly advantageous embodiment of the apparatus according to the invention, a surface for the translation of the core is provided, downstream of the dispensing opening, which is intended to remove any surplus glue. This translation surface is preferably substantially flat, and the means which prevent the rotation of the core are so positioned as to stop their action when the core is moved beyond said surface for the removal of excess glue.

The invention further refers to a rewinding machine including an apparatus of the above-mentioned type for the distribution of glue on the tubular cores.

The invention further refers to a method for the application of glue onto a tubular core for the winding of web material for the production of rolls or logs, including the steps of: feeding the glue in a substantially continuous way over an overflow opening; and moving a core to be provided with glue over said opening, so as to have a continuous or discontinuous strip of glue applied thereon. In a preferred embodiment of the method according to the invention, some of the glue is removed by scraper means after the application thereof, to achieve an optimal distribution, at least partially preventing the winding rollers from being smeared by the glue present on the core as the core is inserted in the winding region.

With the above and other objects in view, further information and a better understanding of the present invention may be achieved by referring to the following detailed description.

BRIEF DESCRIPTION OF THE DRAWINGS

For the purpose of illustrating the invention, there is shown in the accompanying drawings a form thereof which is at present preferred, although it is to be understood that the various instrumentalities of which the invention consists can be variously arranged and organized, and that the invention is not limited to the precise arrangement and organizations of the instrumentalities as herein shown and described.

In the drawings, wherein like reference characters indicate like parts.

DETAILED DESCRIPTION OF PREFERRED EMBODIMENT

Figure 1:
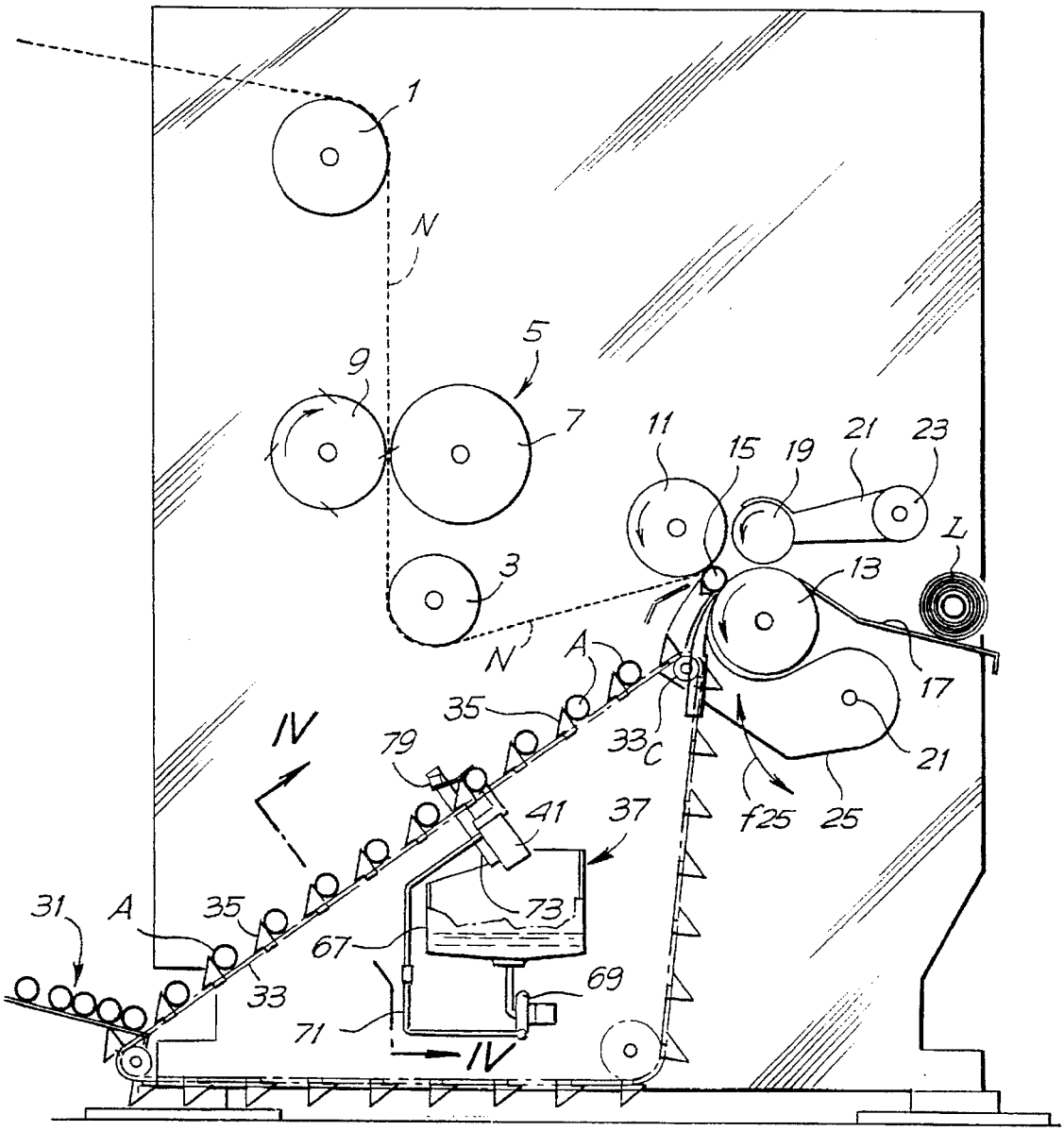
FIG. 1 shows a schematic side view of a rewinder including the glue-applying apparatus according to the invention.

FIG. 1 shows, in a very schematic way, the structure of an automatic surface rewinder wherein the apparatus according to the invention is applied. It will be appreciated that the construction of the rewinder may vary, with respect to that illustrated, without departing from the inventive idea on which the gluer is based.

Indicated by N is the web material which is fed to the winding region and guided by the rollers 1 and 3. Numeral 5 indicates a perforation group comprised of a fixed roller 7 with a counterblade cooperating with a plurality of blades disposed on the rotary roller 9. The perforation group 5 provides transverse perforation lines across the web material N.

Indicated by 11 and 13 are first and second winding rollers rotating in counterclockwise direction and defining a nip 15 through which the web material N passes and into which cores A are fed to wind the web into logs. Reference L indicates a log just formed and unloaded from the winding region onto an inclined discharge surface 17 towards further processing means (not shown). Numeral 19 indicates a third winding roller carried by oscillating arms 21 hinged at 23 on the machine frame. The oscillation motion of the roller 19 about the axis 23 makes it possible to keep under control, in a manner well-known in the art, the winding of the log L and, thus, the increase of its diameter. Numeral 25 indicates an inserting member which provides for successively inserting cores A into the nip 15. The inserting member 25 is hinged at 21 to the machine frame and moves with an oscillation motion according to double arrow f25.

The cores A are picked up from a container 31 by a chain conveyor 33 carrying a plurality of pushers 35 each of which makes up a seat for a respective core A. In FIG. 1 there are illustrated only few pushers 35 disposed along the conveyor 33, but it is understood that they are distributed uniformly and at regular intervals throughout the length of the conveyor.

Figure 2:
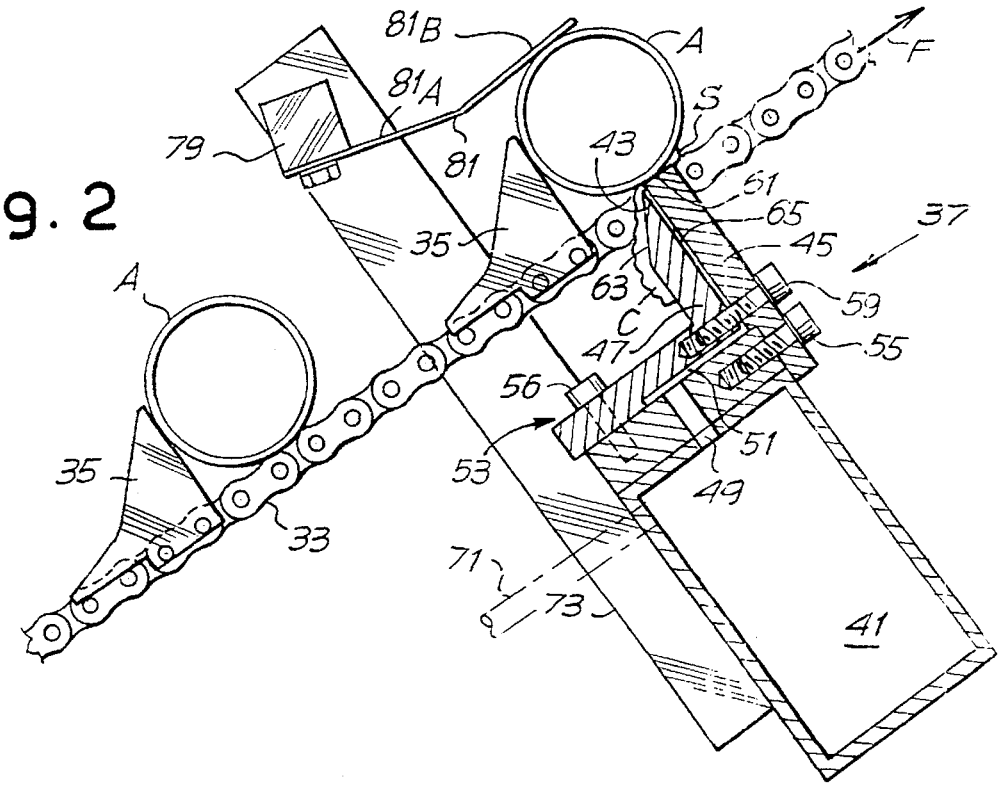
FIGS. 2 and 3 show the glue-application region in two successive steps.
Figure 3:
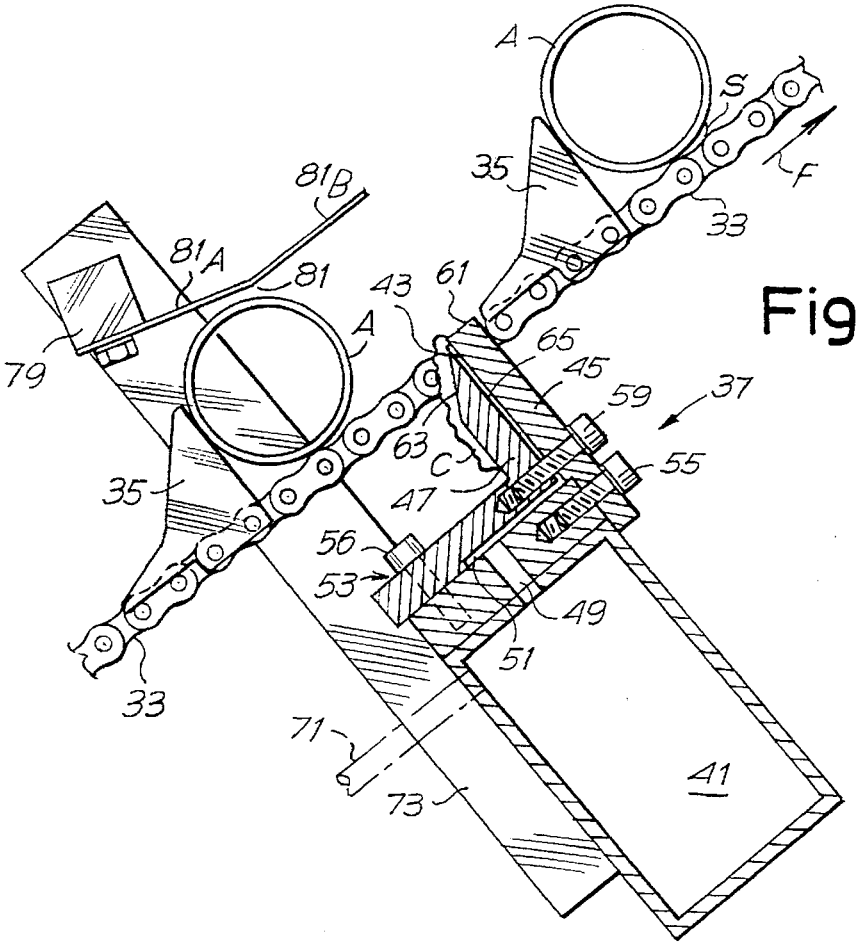
Figure 4:
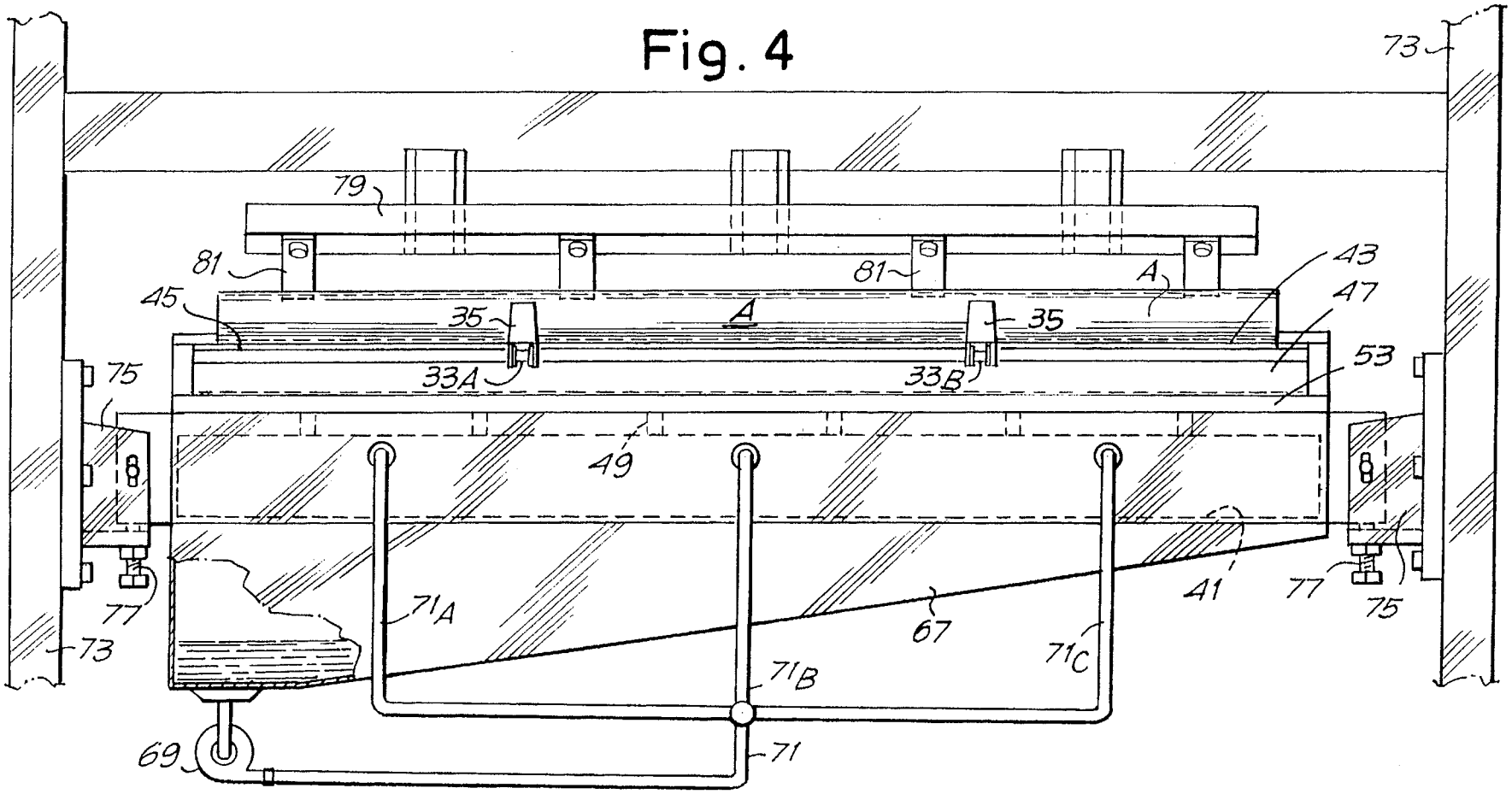
FIG. 4 shows a schematic view on line IV—IV of FIG. 1.

Disposed along the path of the conveyor 33, upstream of the region of insertion of the cores into the rewinder, is a group 37 for the application of glue on the outer surface of the tubular cores, as illustrated in details in FIGS. 2 to 4.

The distributor comprises a tubular chamber 41, of rectangular cross-section in the drawing, which extends substantially the entire width of the machine. The chamber 41 forms a reservoir for the glue, the latter being fed substantially continuously and under slight pressure to a chamber or opening 43 delimited by the walls 45 and 47. The glue reaches the chamber delimited by the opposite surfaces of walls 45 and 47 through a duct 49 and a slot 51 formed in the lower surface of the L-shaped section, generally indicated by 53, which forms the wall 47.

The wall 45 is firmly fixed to the reservoir 41 by screw means 55, while the L-shaped section 53 which defines the wall 47 is firmly connected to the structure 41 by screws 56 and engaged to the wall 45 by screw means 59, so as to allow the distance between the opposing surfaces of walls 45 and 47 to be adjusted and, therefore, to adjust the width of the opening 43 from which the glue C overflows.

The wall 45 ends at top with a surface 61 which is substantially parallel to the direction F of advancement of the cores fed by conveyor 33. On the other hand, the wall 47 is defined on top by a surface 63 which is sharply inclined with respect to the direction F and forming, with the inner surface 65 of the wall 47, a sharp edge. The edge formed by the surfaces 63 and 65 is located, with respect to the plane of movement of the cores A, just below the flat surface 61.

The glue C which overflows from the opening 43 is collected in a storage tank 67 located beneath the reservoir 41 and illustrated in FIGS. 1 and 4. From the storage tank 67 the glue is drawn out through a pump 69 which provides for re-circulating the glue through a conduit schematically shown at 71 which, via a series of branches 71A, 7lB and 71C (three in FIG. 4) pumps the glue back into the tubular reservoir 41. The presence of branches 71A, 7lB, 71C allows the glue to be fed to different points along the length of the tubular reservoir 41 so as to have a substantially uniform supply of glue overflowing across the entire length of the opening 43.This is necessary especially because the glue used for the cores is particularly viscous and, thereby, able to be pumped along the reservoir 41 only with difficulty.

As shown in FIG. 4, the bottom of the storage tank 67 is inclined so as to facilitate the collection of glue sucked by pump 69 from the lowest region of the bottom of tank 67. The tank is supported by the side panels, indicated by 73, through supports 75 provided with screw-operated adjusting means 77 which allow the adjustment of the vertical position of the whole group 37 with respect to the chains 33A, 33B.

Moreover, FIG. 4 shows also the position of walls 45 and 47 defining the opening 43, with respect to the chains 33A and 33B making up the conveyor 33 and on which the core A rests. As clearly shown in FIG. 4, the walls 45, 47 are interrupted in two points to allow the passage of chains 33A and 33B which must carry the relevant cores A in such a way as to cause them to travel on a plane tangent to the opening 43, from which the flat surface 61 of wall 45 is made to slightly project.

Disposed above the reservoir 41 is a transversal section 79 to which flexible plates 81 are connected, which are flare-shaped to allow the passage of the cores A therebelow. Each plate 81 has a flat portion 81A anchored at one end to the section 79, and a distal portion 8lB, inclined with respect to the portion 81A and intended for contacting the upper surface of the cores A. The position of the plates 81 is such that the travel of a core A will cause a flexing of said plates 81 which, as a result, will force said cores against the pushers 35 and the chains 33A and 33B of the conveyor 33. This prevents the cores A from rolling on the surface 61 during the passage thereof through the glue-distributing group 37. This particular arrangement allows an optimal distribution of the glue which is in part scraped away by the surface 61 which acts as a scraper downstream of the dispensing opening 43. The plates 81 extend to the farthest edge of surface 61, so that the pressure of said plates on the core A stops simultaneously with the action of the surface 61.

As shown in FIGS. 2 and 3, as the core A passes above the opening 43 and moves along the surface 61, an unsymmetrical longitudinal strip of glue S is applied thereto. More particularly, the glue strip has a greater thickness in the more advanced region with respect to the direction of advancement of the conveyor 33. The purpose of this asymmetrical distribution will be explained below with reference to FIGS. 5 to 7. In the drawing, the strip S is shown not in scale and being greatly enlarged with respect to its real dimensions.

Figure 5:
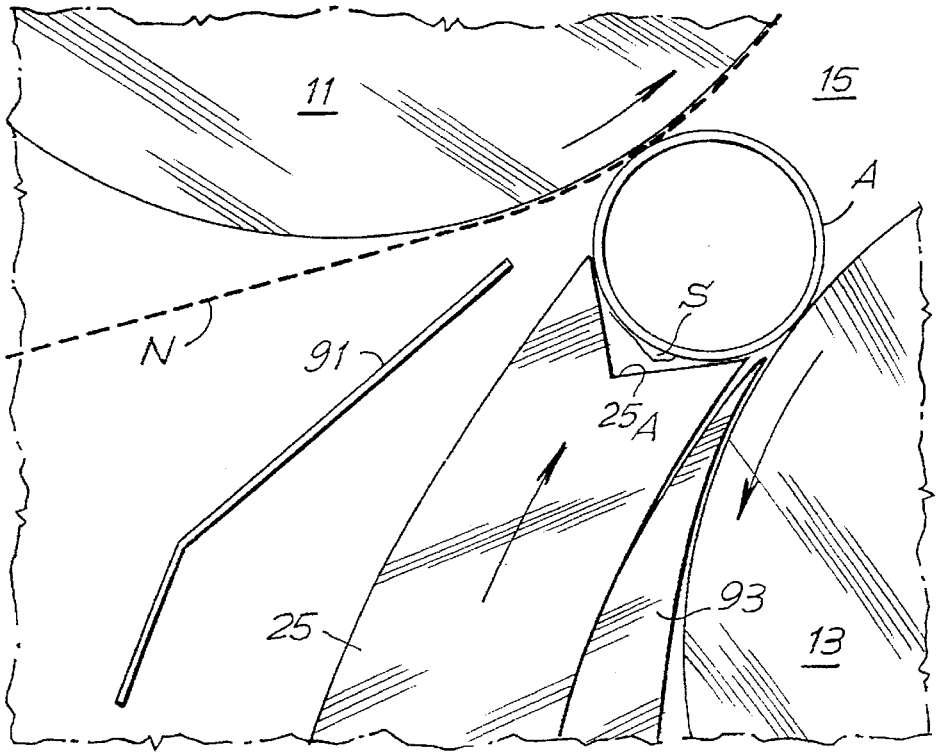
FIGS. 5, 6 and 7 show subsequent steps of fixing the free or leading edge of web material on the core being inserted into the nip between the winding rollers.

FIG. 5 shows the core A the instant it is forced by the inserting member 25 between the rollers 11 and 13. The nip 15 has a development which is slightly smaller than the diameter of the core A, so that the latter is slightly squeezed while passing through the nip. It is to be understood that at least one of the rollers 11 and 13 may have a movable axis, so as to allow a variation of the dimension of nip 15 during the passage of the core.

In the instant condition represented in FIG. 5, the core A comes into contact with the web material N which is thus pinched between the core A and the winding roller 11 on which the web material is driven. In this condition, the strip of glue S is in the lower region of the core A, in alignment with the V-shaped profile 25A of the inserting member 25. From a comparison between FIG. 3 and FIG. 5, it can be noted that a variation of the angular position of the strip S has occurred, due to the fact that the inserting member 25 picks up the core A when it has already performed a partial rotation around the transmission wheel 33C (FIG. 1) of the conveyor 33. Shown in FIGS. 5, 6 and 7 are two plates 91, 93 disposed upstream of nip 15, which prevent a premature contact between the core and the web material, and between the core and the winding roller 13.

As soon as the core A comes in contact with both the surfaces of rollers 11 and 13 which rotate in counterclockwise direction, the core is caused to rotate. The peripheral speed of the roller 13 is slightly lower than the peripheral speed of the roller 11, and this causes the core A to advance along the nip 15 towards the winging region defined by the three rollers 11, 13, 19.

Figure 6:
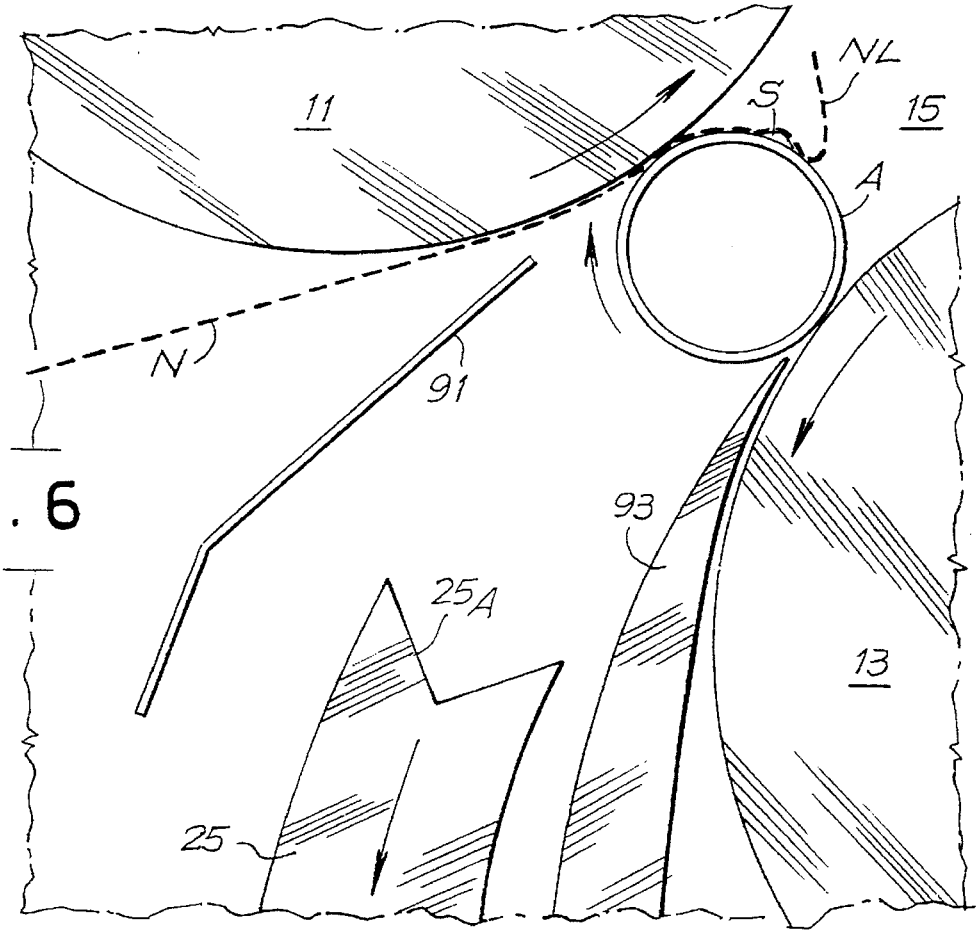

FIG. 6 shows a subsequent step in which the core A has already performed a rotation of approximately 180 degrees, so that the strip of glue S is now facing the nip 15. The web material N has been severed or torn and has a free or leading edge NL anchored on the core A by means of the strip of glue S. The clockwise rotation of the core A tends to lift the free edge NL out of the core surface and thus to uncover a portion of the strip S of glue. The asymmetric distribution of glue along the strip S is such that the region of said strip which tends to become uncovered by the lifting of the free edge NL, is the one having the lowest quantity of glue. The latter, being very thick and tending to dry quite rapidly, is virtually already dry in this region which tends to become uncovered. As a result, when the strip S is in alignment with the surface of the winding roller 13, even if a portion of said strip is uncovered because of the lifting of the free edge NL, the transfer of glue to the roller 13 is practically avoided.

Figure 7:
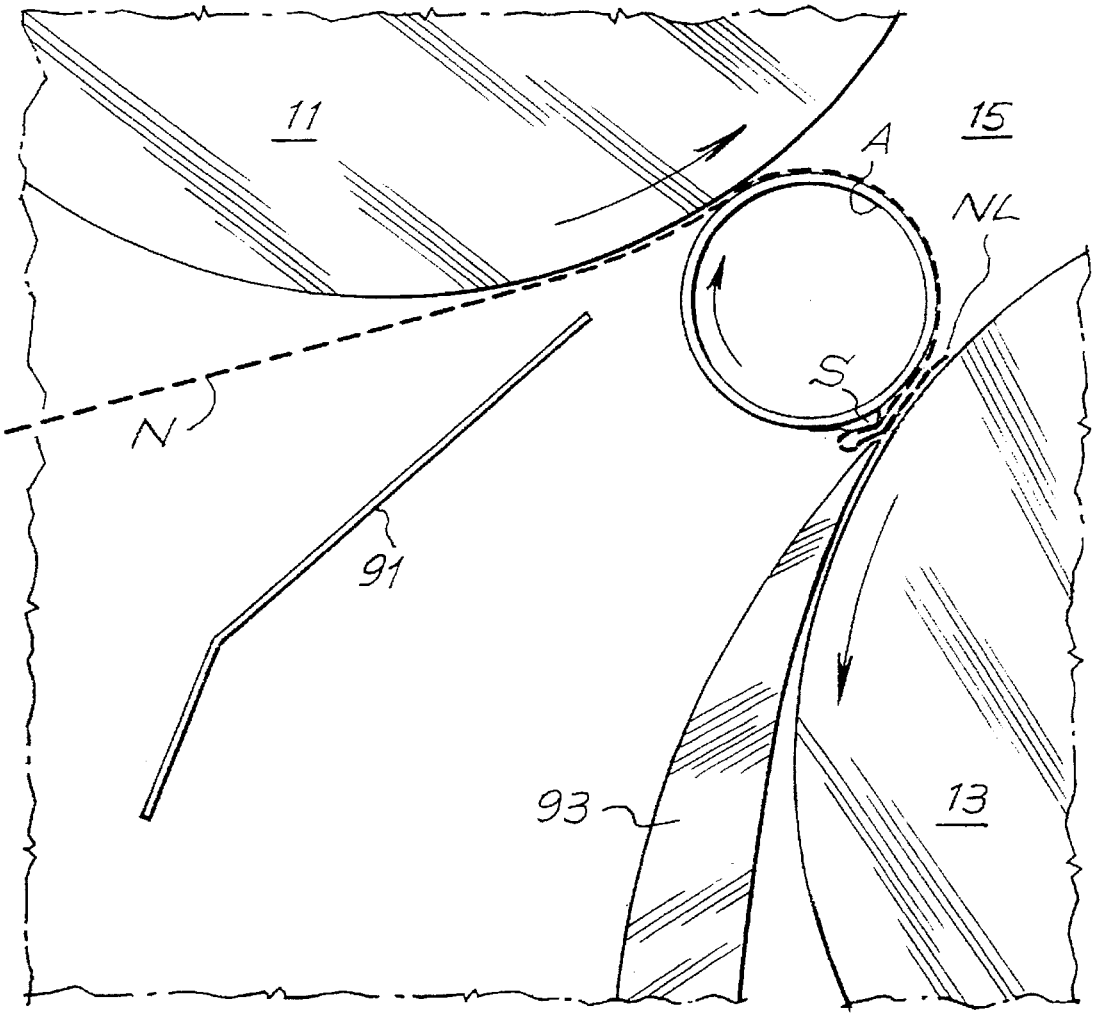

FIG. 7 shows the subsequent step in which the core A has performed a further rotation through almost 180 degrees, so that the strip of glue S is made to face again the region from which the core is coming. As the core A keeps on rotating, the whole of strip S is covered by the web material so that there is no risk for the winding rollers to become smeared with the glue.

It is understood that the drawing shows an exemplification given only as a practical demonstration of the invention, as this may vary in the forms and dispositions without nevertheless coming out from the scope of the idea on which the same invention is based. The possible presence of reference numbers in the appended claims has the purpose of facilitating the reading of the claims, reference being made to the description and the drawing, and does not limit the scope of the protection represented by the claims.

I claim:

1. Apparatus for applying glue on tubular cores (A) to be inserted in a rewinder for the winding of logs (L) of web material (N) , with a conveyor (33) to feed said cores in succession and means (37) for distributing glue on said cores, characterized in that:

said distributing means are provided with a dispenser (41–47) having at least an opening (43) through which the glue is delivered substantially continuously;

said conveyor (33) moves each core (A) over said opening (43) to bring it in contact with the dispensed glue to cause, the application of the glue during the movement of the core, means are provided to prevent the rotation of the core (A) as it moves over said opening;

and, disposed downstream of said opening (43), is a scraping means (61) which removes excess glue applied on the core (A).

2. Apparatus according to claim 1 characterized in that said means to prevent the rotation of the core include a flexible plate (81) which presses on the core (A) diametrically opposite the side of the core in contact with said opening (43).

3. Apparatus according to claim 2 characterized in that said scraping means includes a surface (61) on which said core moves, said surface having an edge which removes excess glue from the core.

4. Apparatus according to claim 3 characterized in that said surface is substantially flat.

5. Apparatus according to claim 2, 3 or 4 characterized in that said means (81) which prevents the rotation of the core are so positioned as to cease their effect on the core when the core comes out of contact with said scraper means (61).

6. Apparatus according to claim 3 characterized in that said opening (43) is defined by the edge of said surface (61) and by an edge of a delimiting wall (47), which is disposed slightly below the edge of said surface (61).

7. Rewinding machine for the production of logs of web material (N) wound on a winding core (A), with a first winding roller (11) and a second winding roller (13), said winding rollers defining a nip (15) through which the web material (N) passes and within which the core on which the web material to be wound is fed, and with a feeding means (33) to feed said cores to an apparatus (37) for applying a strip (S) of glue on said cores in order to anchor the leading edge of the web material at the beginning of the winding, characterized in that said apparatus for applying the glue is realized according to claim 3.

8. Apparatus according to claim 7 characterized in that in that it comprises an inserting member (25) to insert the cores into said nip, having an approximately V-shaped cross section (25A) to avoid the contact with the strip (S) of glue deposited on the core.

9. Rewinding machine for the production of logs of web material (N) wound on a winding core (A), with a first winding roller (11) and a second winding roller (13), said winding rollers defining a nip (15) through which the web material (N) passes and within which the core on which the web material to be wound is fed, and with a feeding means (33) to feed said cores to an apparatus (37) for applying a strip (S) of glue on said cores in order to anchor the leading edge of the web material at the beginning of the winding, characterized in that said apparatus for applying the glue is realized according to claim 2.

10. Apparatus according to claim 9 characterized in that it comprises an inserting member (25) to insert the cores into said nip, having an approximately V-shaped cross section (25A) to avoid the contact with the strip (S) of glue deposited on the core.

11. Apparatus according to claim 1 characterized in that said distributing means includes a reservoir (41) of glue, a conduit (49) for connecting said reservoir (41) to said opening (43); a storage tank (67) for collecting excess glue fed from said opening (43), and pump means (69) for drawing the glue out of said storage tank (67) and re-admitting it into said reservoir (41).

12. Apparatus according to claim 11 characterized in that the glue is admitted into said reservoir through a plurality of supply conduits (71A, 7IB, 71C) distributed along the reservoir (41).

13. Apparatus according to claim 1 characterized in that the width of said opening (43) is adjustable.

14. Apparatus according to claim 1 characterized in that the position of said opening (43) is adjustable with respect to the trajectory of the conveyor (33).

15. Rewinding machine for the production of logs of web material (N) wound on a winding core (A), with a first winding roller (11) and a second winding roller (13), said winding rollers defining a nip (15) through which the web material (N) passes and within which the core on which the web material to be wound is fed, and with a feeding means (33) to feed said cores to an apparatus (37) for applying a strip (S) of glue on said cores in order to anchor the leading edge of the web material at the beginning of the winding, characterized in that said apparatus for applying the glue is realized according to claim 1.

16. Apparatus according to claim 15 characterized in that it comprises an inserting member (25) to insert the cores into said nip, having an approximately V-shaped cross section (25A) to avoid the contact with the strip (S) of glue deposited on the core.

17. Method for applying glue on a core (A) on which a web material is wound for the production of logs (R) of reeled web material characterized by:

feeding the glue substantially continuously to an opening (43) from which the glue is discharged by overflow;

moving a core to be glued over said opening, preventing the rotation of the core, so as to deposit a strip (S) of glue thereon;

and removing excess glue from said core by moving the core on a stationary scraping means (61) located beyond said opening (43).

* * * * *